US008369754B2

(12) United States Patent
Itagaki et al.

(10) Patent No.: US 8,369,754 B2
(45) Date of Patent: Feb. 5, 2013

(54) DEVELOPING DEVICE AND IMAGE FORMING APPARATUS

(75) Inventors: Seiko Itagaki, Hachioji (JP); Hiroshi Akita, Musashino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/810,284

(22) PCT Filed: Jun. 26, 2009

(86) PCT No.: PCT/JP2009/061711

§ 371 (c)(1), (2), (4) Date: Jun. 23, 2010

(87) PCT Pub. No.: WO2010/004886

PCT Pub. Date: Jan. 14, 2010

(65) Prior Publication Data

US 2011/0097116 A1 Apr. 28, 2011

(30) Foreign Application Priority Data

Jul. 11, 2008 (JP) ..... 2008-181191

(51) Int. Cl.
*G03G 15/09* (2006.01)

(52) U.S. Cl. ..... 399/269; 399/270

(58) Field of Classification Search ..... 399/269, 399/270

See application file for complete search history.

(56) References Cited

U.S. PATENT DOCUMENTS 4,266,868 A * 5/1981 Bresina et al. ..... 399/269
4,565,437 A * 1/1986 Lubinsky ..... 399/269 X

FOREIGN PATENT DOCUMENTS

JP 10-171252 6/1998
JP 2001-290364 10/2001

OTHER PUBLICATIONS

English-language International Search Report from the Japanese Patent Office mailed Jul. 21, 2009, for International Application No. PCT/JP2009/061711.

* cited by examiner

*Primary Examiner* — David Gray
*Assistant Examiner* — Erika J Villaluna
(74) *Attorney, Agent, or Firm* — Finnegan, Henderson, Farabow, Garrett & Dunner, L.L.P.

(57) ABSTRACT

Provided is a developing device employing a two-component developer where a good image can be obtained by preventing the influence of scratching caused by a magnetic brush. A developing device comprises a first develop roller (41) for developing an electrostatic latent image, formed by the two-component developer on an image carrier (1), in a first development area (n1), and a second develop roller (42) for carrying toner supplied from the first develop roller (41) on the outer circumferential surface and developing the electrostatic latent image on the image carrier (1) in a second development area (n2) on the downstream side of the first development area (n1) in the rotational direction of the image carrier (1), wherein the moving direction of the outer circumferential surface of a sleeve (41A) is reverse to the moving direction of the surface of the image carrier (1) in the first development area (n1), and a position (n3) at which to supply toner from the first develop roller (41) to the second develop roller (42) is locate downstream of a regulation position (n4) in the rotational direction of the first develop roller and upstream of the first development area (n1).

5 Claims, 6 Drawing Sheets

DEVELOPING DEVICE AND IMAGE FORMING APPARATUS

CROSS REFERENCE TO RELATED APPLICATIONS

This application is a national phase application based on International Application No. PCT/JP2009/061711, filed Jun. 26, 2009, which claims the priority of Japanese Patent Application No. 2008-181191, filed Jul. 11, 2008, the content of both of which is incorporated herein by reference.

TECHNICAL FIELD

The present invention relates to a developing device used to form an image by an electrophotographic method using a two-component developer, and an image forming apparatus provided with the same.

BACKGROUND ART

In recent years, an image forming apparatus using an electrophotographic method is required to meet the needs for higher speed and higher image quality. To meet the requirement for higher speed, the linear speed of an image carrier such as a photoreceptor must be increased. If the linear speed of the image carrier is increased, however, various forms of problems will arise in the process of development.

When the linear speed of the image carrier is increased, the major problem related to image finality in the process of development is that the width of the settable fogging margin known as the "operation window" is narrowed.

The fogging margin is the potential difference between the charging potential of the image carrier (potential of the unexposed portion in the photoreceptor) and the DC component of the development bias potential. The fogging margin is generally set to a value wherein neither fogging nor carrier deposition should occur.

As the fogging margin is greater, generation of fogging is reduced, but deposition of carrier is more heavily caused by the counter-charge phenomenon that occurs in the development area at the time of development. The counter-charge can be defined here as a phenomenon in which carrier is charged by exchange of electric charge between the toner having been developed (transferred) from the development roller to the carrier and the carrier carried by the development roller.

Development is performed by two methods: a with-rotation method where development is performed by moving the image carrier and development roller in the same direction in the development area where they are opposed to each other; and a counter-rotation method where development is performed by moving the image carrier and development roller in different directions. From the viewpoint of reducing the carrier deposition, the counter-rotation method is superior. This is because in the development by the counter-rotation method, the moving direction of the electrically charged carrier is directed upstream of the development area, and a fresh carrier, which is not electronically charged, is supplied on the downstream side of the development area.

In the counter-rotation method, however, the relative speed between the development roller and image carrier is generally high. When a half-tone or solid black image is developed, toner will be swept to the edge of the image by the sliding of the magnetic brush formed on the development roller surface, and the density of that portion is higher than other portions. This is often called "gathered toner", which reduces the image quality.

On the other hand, there is another development method which employs one-component developer, in which method toner charged without carrier is carried on a development roller to perform development. The development method using the one-component developer is superior in uniformity of image, but is inferior with respect to increasing speed and gradation reproduction.

In an effort to solve this problem, Patent Document 1 proposes an image forming apparatus using a development roller incorporating a magnet and carrying two-component developer, and a development roller carrying one-component developer. This image forming apparatus performs multi-stage development using two development rollers. This is intended to improve the development quality and to prevent a white patch by using two development rollers, and intended to prevent a phenomenon which disturbs images, by performing scavenging development, that is to say, mechanically or electrostatically scraping with carrier an image being carried.

Further, in the developing device disclosed in the Patent Document 2 that uses only the two-component developer for cost reduction purposes, where toner is supplied from a magnetic roller carrying the two-component developer to a one-component toner roller. This structure eliminates the need for a development chamber incorporating one-component developer.

DOCUMENTS OF CONVENTIONAL ART

Patent Documents

Patent Document 1: Unexamined Japanese Patent Application Publication No. H10-171252

Patent Document 2: Unexamined Japanese Patent Application Publication No. 2001-290364

SUMMARY OF THE INVENTION

Problems to be Solved by the Invention

When consideration is given to increase in speed, the image forming apparatus described in Patent Document 1 has a problem of charging one-component toner and a problem that two types of developer, one-component developer and two-component developer, are required.

In the developing device described in Patent Document 2, the step of supplying toner from the magnetic roller to the one-component toner carrying roller is performed after the magnet roller has performed development This may cause the supply of toner to the one-component toner carrying roller to be unstable. The supply will be seriously affected especially in the case of developing a solid image where much toner is consumed. For example, when a latent image with the shape of a cross is developed, in the vertical bar area, much toner consumption is consumed, so that the supply of toner to the one-component toner carrying roller tends to be insufficient. Accordingly, at the time of developing the horizontal bar area, the supply of toner is more insufficient at the intersection between the vertical and horizontal bars than at other places. This results in a lower density at this intersection, hence an uneven density.

Further, in the developing device described in Patent Document 2, development is performed by the with-rotation method wherein the image carrier and development roller are moved in the same direction in the development area. Therefore, the width of the fogging margin may be reduced as above-described when increasing the speed.

In view of the problems described above, it is an object of the present invention to provide a developing device using two-component developer, wherein a high-quality image is generated by reducing the influence of the sliding scratching by a magnetic brush.

Means for Solving the Problems

Item 1. A developing device, comprising a storage section for storing a two-component developer containing toner and carrier;

a first development roller which includes therein a fixed magnetic pole, and is configured to carry, on a circumferential surface of a rotating sleeve, the two-component developer stored in the storage section, and configured to develop in a first development area an electrostatic latent image formed on an image carrier, with the caned two-component developer;

a layer thickness regulating section for regulating at a regulation position an amount of the two-component developer carried on the circumferential surface of the sleeve; and a second development roller which is configured to carry on a circumferential surface thereof toner supplied from the first development roller, and to develop the electrostatic latent image on the image carrier, in a second development area which is on a downstream side from the first development area in a rotating direction of the image carrier, wherein the circumferential surface of the sleeve and a surface of the image carrier move in different directions from each other, and a supply position at which the first development roller supplies the toner to the second development roller is located on a downstream side from the regulation position and on a upstream side of first development area in a rotating direction of the first development roller.

Item 2. The developing device of item 1, wherein development biases are applied to the first development roller and the second development roller so as to form an electric field which transfers the toner from the first development roller to the second development roller.

Item 3. An image forming apparatus, comprising:

an image carrier, a charging section for charging the image carrier, an exposure section for forming an electrostatic latent image on a surface of the image carrier;

a developing device of item 1 or 2 for developing the electrostatic latent image with toner to form a visible image, and a transfer section for transferring the visible image to a transfer medium.

Advantages of the Invention

The developing device of the present invention includes a first development roller carrying two-component developer and a second development roller carrying toner. The supply position where toner is supplied from the first development roller to the second development roller is located upstream from a first development area. This structure provides a high-quality image with reduced influence of scratching by a magnetic brush.

EMBODIMENT FOR CARRYING OUT THE INVENTION

The following describes the present invention with reference to the embodiments, without the present invention being restricted thereto.

[Image Forming Apparatus]

Figure 1:
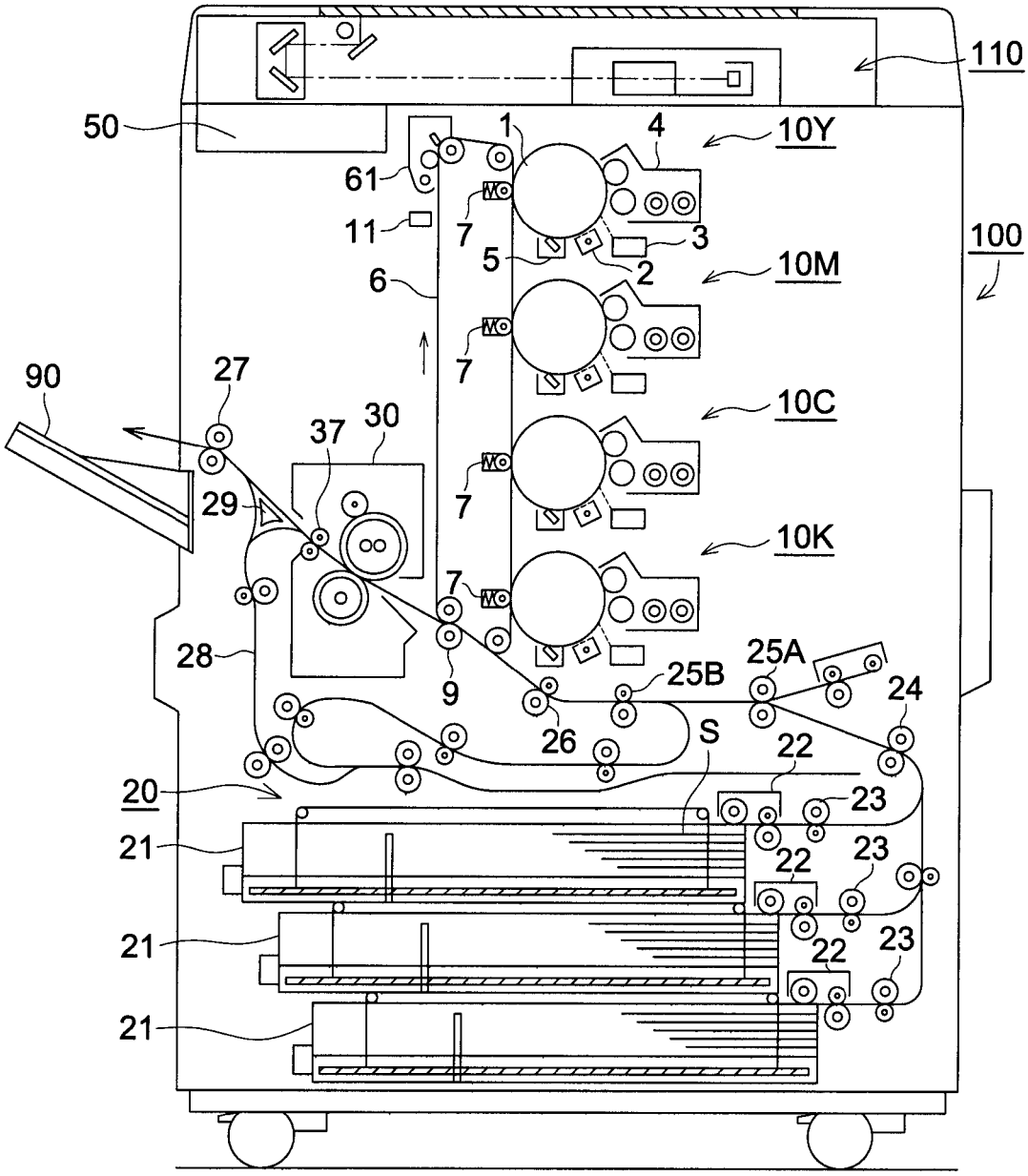
FIG. 1 is a diagram representing the major portions of an image forming apparatus 100.
Figure 2:
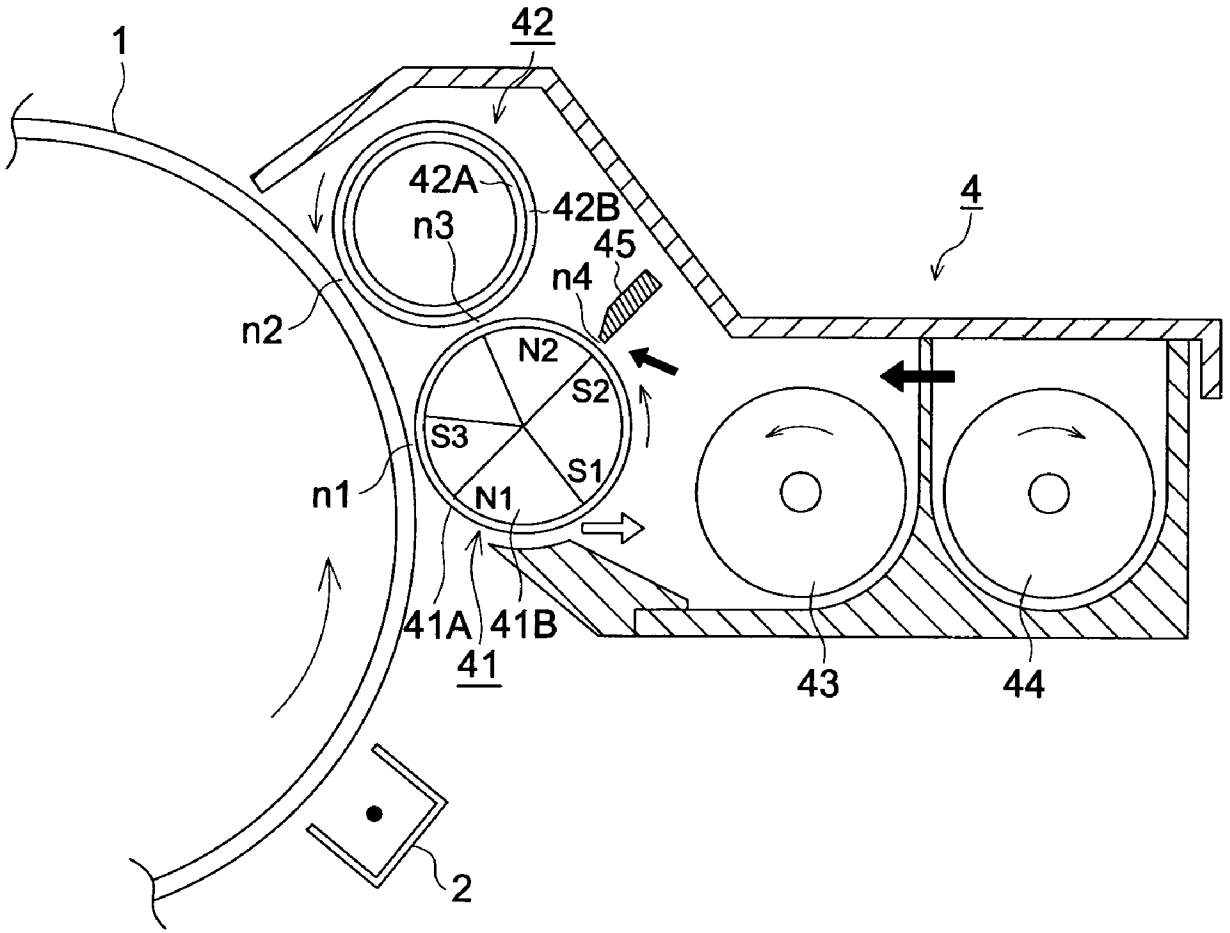
FIG. 2 is a diagram representing the periphery of a developing device 4 of a first embodiment according to the present invention.
Figure 3:
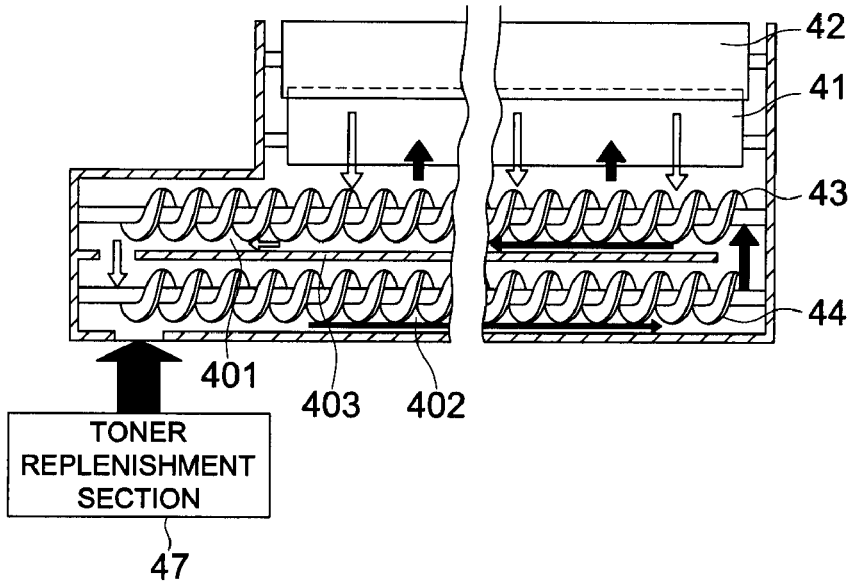
FIG. 3 is a plan view representing the developing device 4.

Referring to FIGS. 1 through 3, the following describes an image forming apparatus of a first embodiment according to the present invention. FIG. 1 is a diagram representing the major portions of an image forming apparatus 100.

The image forming apparatus 100 is an apparatus called a tandem color image forming apparatus and includes a plurality of image forming devices 10Y, 10M, 10C and 10K, a belt-shaped intermediate transfer belt 6, a sheet feed device 20, and a fixing device 30.

A scanner 110 is installed on the top of the image forming apparatus 100. An image of a document placed on a document platen is subjected to scanning and exposure by the optical system of the document image scanning/exposure device and is read by a linear image sensor. An analog signal generated by the photoelectric conversion by the line image sensor undergoes analog processing, analog-to-digital conversion, shading correction, and image compression by a control means before being inputted into an exposure section 3

In the present Specification, the components are collectively denoted by reference symbols without alphabetical subscripts, and individual components are denoted by the reference symbol with subscripts: Y (yellow), M (magenta), C (cyan) and K (black).

An image forming device 10Y for forming a yellow (Y) image, an image forming device 10M for forming a magenta (M) image, an image forming device 10C for forming a cyan (C) image, and an image forming device 10K for forming a black (K) image each include a charging pole 2, an exposure section 3, a development apparatus 4, and a cleaning 5 arranged around a drum-shaped photoreceptor 1 as an image carrier, (reference symbols omitted for M, C and K).

For example, the photoreceptor 1 is constituted by a drum-shaped metal substrate and a photosensitive layer, of a resin containing organic material, formed on the outer peripheral surface of the drum-shaped metallic substrate. The photoreceptor 1 is arranged to be extending in the width direction (vertical direction with respect to the paper face in FIG. 1) of the sheets S being conveyed. The resin constituting the photosensitive layer can be exemplified by a polycarbonate. The embodiment of FIG. 1 has been described with reference to the exemplary structure using the photoreceptor 1. Without the embodiment being restricted thereto, a belt-shaped photoreceptor can be utilized.

The developing devices 4 each house two-component developer made of carrier and small-diameter toner of different color of one of yellow (Y), magenta (M), cyan (C) and black (K). The two-component developer contains carrier coated with an insulative resin around ferrite as a core, and toner comprised of polyester as a main material; a coloring agent such as pigment or carbon black, charge regulating agent, silica and titanium oxide. The carrier has a particle diameter of 10 through 50 μm and a saturation magnetization of 10 through 80 emu/g, and the toner has a particle diameter of 4 through 10 μm. The toner has a negative-charge characteristic, and an average amount of electric charge of −20 through −60 μC/g. The two-component developer used in the embodiment is made by mixing the carrier and toner together in such a way that the toner has a density of 4 through 10% by mass.

The belt-shaped intermediate transfer belt 6 is supported rotatably by a plurality of rollers. The intermediate transfer belt 6 is an endless belt with a specific volume resistance of $10^6$ through $10^{12}$ Ω·cm, including a semiconductor seamless belt having a thickness of 0.04 through 0.10 mm made of an engineering plastic such as denatured polyimide, thermoplastic polyimide, ethylene tetrafluoroethylene copolymer, vinylidene polyfluoride, or nylon alloy, with conductive material dispersed therein.

The toner images of various colors, on the photoreceptor 1, formed by the image forming devices 10Y, 10M, 10C, and 10K are sequentially transferred onto the rotating intermediate transfer belt 6 by a primary transfer roller 7 (the primary transfer step), and a composite color image is formed. In the meantime, the toner remaining on the photoreceptors 1Y, 1M, 1C, and 1K subsequent to the image transfer is removed by a cleaning section 5.

The sheets S accommodated in the sheet storage section (tray) of the sheet feed device 20 are fed by a sheet feeding section 22, and are conveyed to a secondary transfer roller 9 through sheet feed rollers 23, 24, 25A, and 25B and registration roller (second sheet feed section) 26, whereby a color image is transferred onto the sheet S (the secondary transfer step).

Since e one of storage sections 21 stacked vertically in three levels under the image forming apparatus 100 has almost the same structure, and the same reference numeral is assigned to them. Each one of sheet feeding sections 22 also has almost the same structure, and the same reference numeral is assigned to them. The sheet storage sections 21 and sheet feeding sections 22 are collectively called a sheet feed device 20.

The sheet S with the color image transferred thereto is sandwiched in the fixing device 30, and heat and pressure is applied to the sheet S, whereby the color toner image (or toner image) on the sheet S is fixed and is firmly deposited on the sheet S. The sheet S is then sandwiched by a conveyance roller pair 37 to be conveyed, is ejected through the ejection rollers 27 provided in an ejection conveyance path, and is placed on an ejection tray 90.

After a color image has been transferred onto the sheet S by the secondary transfer roller 9, the remaining toner is removed by a cleaning section 61 from the intermediate transfer belt 6, from which the sheet S has been curvature-separated.

When copying on both sides of the sheet S, the image formed on the first side of the sheet S is once fixed, and the sheet S is branched off from the ejection conveyance path by a branching board 29. Then, the sheet S is led into a duplex transfer path 28. The sheet S is reversed and is again conveyed through the sheet feed roller 25B. The images of respective colors are formed on the second side of the sheet S by the image forming devices 10Y, 10M, 10C, and 10K on both sides. The sheet S is then heated and fixed by the fixing device 30 and is ejected out of the machine by the ejection roller 27.

FIG. 2 is a diagram representing the periphery of the developing device 4 as a first embodiment. FIG. 3 is a plan view representing the developing device 4.

The developing device 4 includes an enclosure 40, first development roller 41, second development roller 42, supply screw 43, agitation screw 44, and layer thickness regulating member 45. The n1 is a first development area, n2 is a second development area, n3 is a supply position, and n4 is a regulation position. The details will be described below.

[First Development Roller 41]

The first development roller 41 includes a rotating sleeve 41A and a non-rotating fixed magnet 41B. The sleeve 41A is made of metal such as aluminum or SUS. For example, the outer diameter of the first development roller 41 is 25 mm, for example. The surface thereof carries 250 g/$m^2$ of a developer layer whose thickness is regulated by the layer thickness regulating member 45 in the regulation position n4.

An AC voltage supplied from an AC power source and a DC voltage supplied from a DC power source are superimposed on the sleeve 41A as a development bias.

In FIG. 2, the first development roller 41 (sleeve 41A), supply screw 43, and photoreceptor 1 rotate in the counterclockwise direction. In the first development area n1, the outer peripheral surface of the photoreceptor 1 and sleeve 41A move in opposite directions, and development is performed by the counter-rotation method. The linear speed of the first development roller 41 is 540 mm/s with respect to the linear speed of the photoreceptor 1 of 300 mm/s. Thus, the rotating speed ratio between the two is a little less than two times.

The fixed magnet 41B is located inside the sleeve 41A, and contains five magnetic poles N1, N2, S1, S2, and S3. The magnetic pole N1 is a main magnetic pole. The magnetic pole S1 is a stripping magnetic pole, and the magnetic pole S2 is a pump-up magnetic pole.

In the plurality of magnetic poles of the non-rotating fixed magnet 41B, mutually adjacent magnetic poles S1 and S2 have the same polarity to form a repulsive magnetic field. The stripping magnetic pole S1 for stripping off the developer strips the developer on the sleeve 41A, and scatters the developer. The pumping-up magnetic pole S2 for receiving developer pumps up the developer supplied by the supply screw 43 and attaches it on the sleeve 41A. A layer thickness regulating member 45 is located in the vicinity of the pumping-up magnetic pole S2.

[Second Development Roller 42]

The second development roller 42 is made of a sleeve 42A and coated layer 42B. The sleeve 42A is made of conductive material having a specific volume resistance of 6 Ω·cm or less. It is made of a conductive metal such as non-magnetic SUS and aluminum. The coated layer 42B provided on the surface of the sleeve 42A is made of conductive resin. The second development roller 42 has an outer diameter of 18 mm, for example, and its surface carries 2 g/$m^2$ of toner.

The second development roller 42 rotates in the counterclockwise direction in FIG. 2. In the second development area n2, the photoreceptor 1 and second development roller 42 move in opposite directions.

An AC voltage supplied from an AC power source and an DC voltage supplied from a DC power source are superimposed on the sleeve 42A. This AC power source and the AC power source for supplying power to the aforementioned first development roller 41 have the same frequency and phase.

The second development roller 42 rotates in the counterclockwise direction in FIG. 2. The photoreceptor 1 and the outer peripheral surface of the second development roller 42 move in opposite directions, and development is performed according to the counter-rotation method. The linear speed of the photoreceptor 1 is 300 mm/s and that of the second development roller 42 is 360 mm/s so that the linear speed of the second development roller 42 will be higher than that of the photoreceptor 1.

The gap between the second development roller 42 and photoreceptor 1 in the second development area is set at 0.15 mm so as to allow non-contact development to be performed.

The latent image of the photoreceptor 1 is developed in the first development area n1 and second development area n2 following the first development area n1. Almost all the development process is performed in the first development area n1 by the first development roller 41. The development to be performed by the second development roller 42 in the second development area n2 is a supplementary step intended to correct a development defect such as brush lines that may occur when development is performed by the first development roller.

[Circulation of Developer]

The developing device 4 shown in FIG. 3 includes a developer supply chamber 401 and a developer agitation room 402 housing the supply screw 43 and the agitation screw 44, respectively. The developer supply chamber 401 and developer agitation room 402 are formed on the respective sides of the partition wall 403 rising uptight from the bottom of the developing device 4. The developer supply chamber 401 and developer agitation room 402 function as a storage section of this present embodiment.

The supply screw 43 agitates and conveys the developer conveyed through the agitation screw 44, and supplies it uniformly to the first development roller 41. Both the supply screw 43 and agitation screw 44 are helical screw members.

The agitation screw 44 is arranged parallel to the supply screw 43. The agitation screw 44 mixes and agitates the new toner replenished from the toner replenishment section 47 and the developer circulated from the sleeve 41A, and conveys them upstream of the supply screw 43.

The supply screw 43 conveys the developer in the direction of the rotational axis, and discharges the developer in a direction almost at right angles to the rotational axis.

As described above, the developer having been conveyed by the supply screw 43 is deposited on the rotating sleeve 41A by the pump-up magnetic pole S2.

[Circulation of Developer Around the First Developer Roller 41]

The regulation position n4, supply position n3, and first development area n1 are arranged on the surface of the first development roller 41 in this order in the rotating direction.

The amount of the developer conveyed on the first development roller 41 is regulated to be less than a predetermined amount by the layer thickness regulating member 45 at the regulation position n4.

The gap between the first development roller 41 and layer thickness regulating member 45 at the regulation position n4, the gap between the first development roller 41 and second development roller 42 at the supply position n3, and the gap between the first development roller 41 and photoreceptor 1 in the first development area n1 are approximately identical, and 0.28 mm, for example. This arrangement causes the magnetic brush formed by the two-component developer to be in contact with the second development roller 42 and photoreceptor 1 in the supply position n3 and the first development area n1, respectively.

The supply position n3 is the point wherein the first development roller 41 comes close to the second development roller 42. At the supply position n3, toner is supplied from the first development roller 41 to the second development roller 42. As described above, since the second development roller 42 is made of a non-magnetic hollow metallic roller, the carrier in the developer on the first development roller 41 remains on the surface of the first development roller 41. Only the toner is supplied by the electric field formed between the first development roller 41 and second development roller 42. As described above, the second development roller 42 rotates in the counterclockwise direction in FIG. 2. This structure ensures that, at the supply position n3, the first development roller 41 and second development roller 42 move in the opposite directions, and provides a stable supply of toner from the first development roller 41 to the second development roller 42. It is also possible to make such an arrangement that the second development roller 42 rotates in the clockwise direction in this diagram. In this case, the rotating directions of the photoreceptor 1 and second development roller 42 are the same in the second development area n2. This enhances the effect of correcting the development defect such as brush lines.

DC voltage V1 is supplied to the sleeve 41A of the first development roller 41 from a DC power source. DC voltage V2 is supplied to the sleeve 42A of the second development roller 42 from the DC power source. For example, the V1 is −500 V, and V2 is −200 V. The toner is a negative charge toner. Thus, only the toner in the two-component developer conveyed on the first development roller 41 is supplied to the second development roller 42 by the electric field formed between the first development roller 41 and second development roller 42. The electric field can be saturated by the electric charge of the toner layer formed on the second development roller 42. This prevents more than a predetermined amount of toner from being supplied to the second development roller 42.

The following describes the advantages provided by the present embodiment:

(1) Development is performed by the counter-rotation method where the outer peripheral portion of the sleeve 41A and the surface of the photoreceptor 1 move in opposite directions in the first development area n1. This arrangement reduces carrier deposition, and expands the fogging margin.

(2) The second development area n2 is located downstream from the first development area n1 in the rotating direction of the photoreceptor 1. Thus, development is first performed by the two-component developer in the first development area n1. This arrangement provides gradation reproducibility superior to that provided by the developing device where only one-component development is performed. This arrangement also avoids uneven density resulting from the fluctuation in potential of the one-component developer, and ensures that high-speed requirements will be met easily. However, since this development is based on the counter-rotation method, the magnetic brush formed of the carrier mechanically and electrically scrapes of the toner image formed on the photoreceptor 1. This tends to cause deterioration in dots and thin lines reproducibility and granularity, and problems of gathered toner.

(3) The aforementioned scraped portion can be covered by the second development roller 42 in the second development area n2. Thus, problems can be solved, and a high-quality image can be ensured.

(4) Further, the supply position n3 is located upstream from the first development area n1 in the rotating direction of the first development roller 41. This arrangement allows toner to be supplied to the second development roller 42 from the first development roller 41 before development. Thus, toner can be supplied without being adversely effected by the hysteresis (amount of toner development) of the latent image on the photoreceptor 1 at the time of development, in comparison to the case where the supply position n3 is located downstream from the first development area n1 in the rotating direction thereof. This ensures uniformity in the amount of the toner conveyed on the surface of the second development roller 42, and hence image uniformity.

Embodiment 2

Figure 4:
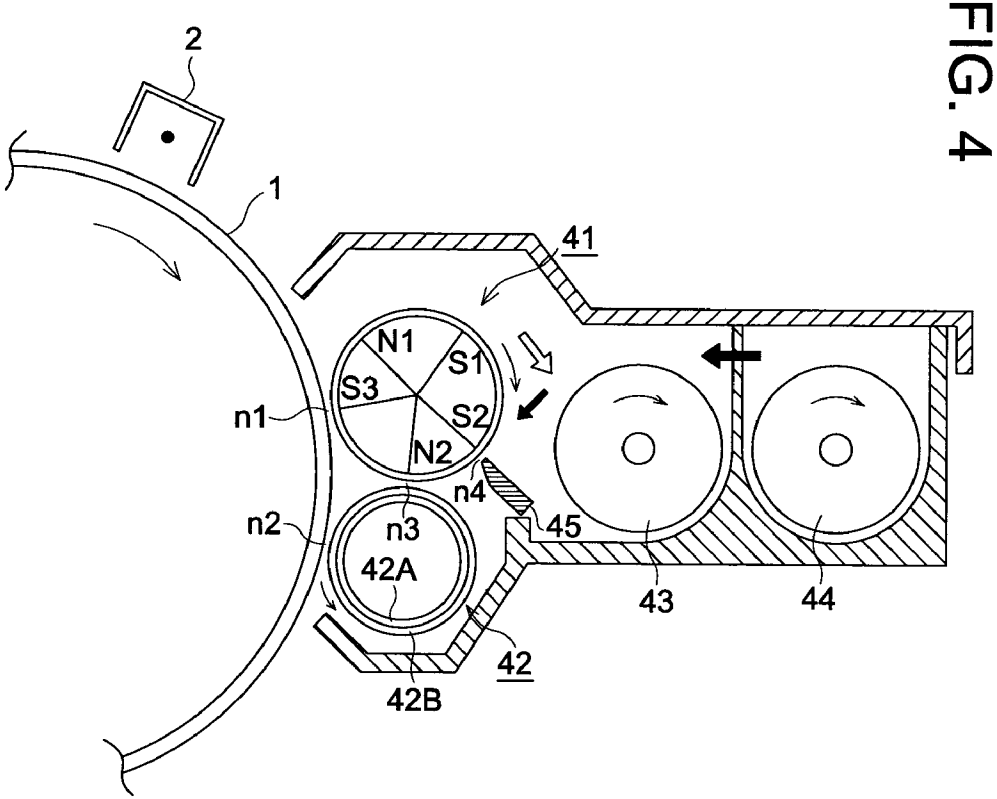
FIG. 4 is a diagram representing the periphery of a developing device 4 of a second embodiment according to the present invention.

FIG. 4 shows a developing device 4 as a second embodiment. The components common in the developing device 4 as the first embodiment shown in FIGS. 1 through 3 will be assigned with the same reference symbols, and will not be described to avoid duplication.

As shown in FIG. 4, a photoreceptor 1 rotates in the clockwise direction in FIG. 4 and a first development roller 41 also rotates in the clockwise direction, and a second development roller 42 rotates in the counterclockwise direction. Thus, similarly to the case of the first embodiment, development is performed by the counter-rotation method where photoreceptor 1 and the outer peripheral portion of the sleeve 41A move in opposite directions in the first development area n1, in the second embodiment. In the meantime, in a second development area n2, development is performed by the with-rotation method where the photoreceptor 1 and the outer peripheral portion of the second development roller 42 move in the same direction. In a supply position n3, the first development roller 41 and second development roller 42 move in the same direction. It is also possible to make such an arrangement that the second development roller 42 rotates in the clockwise direction and, similarly to the case of the first embodiment, development is performed by counter-rotation method in the second development area n2, and the operation of supply is performed by the counter-rotation method in the supply position n3.

EXAMPLES

The following describes the examples of the present invention.

Test Conditions

Example

Based on the conditions given in Table 1, tests were conducted using the image forming apparatus 100 and developing devices 4 shown in FIGS. 1, 2, and 4.

Comparative Example 1

Figure 5:
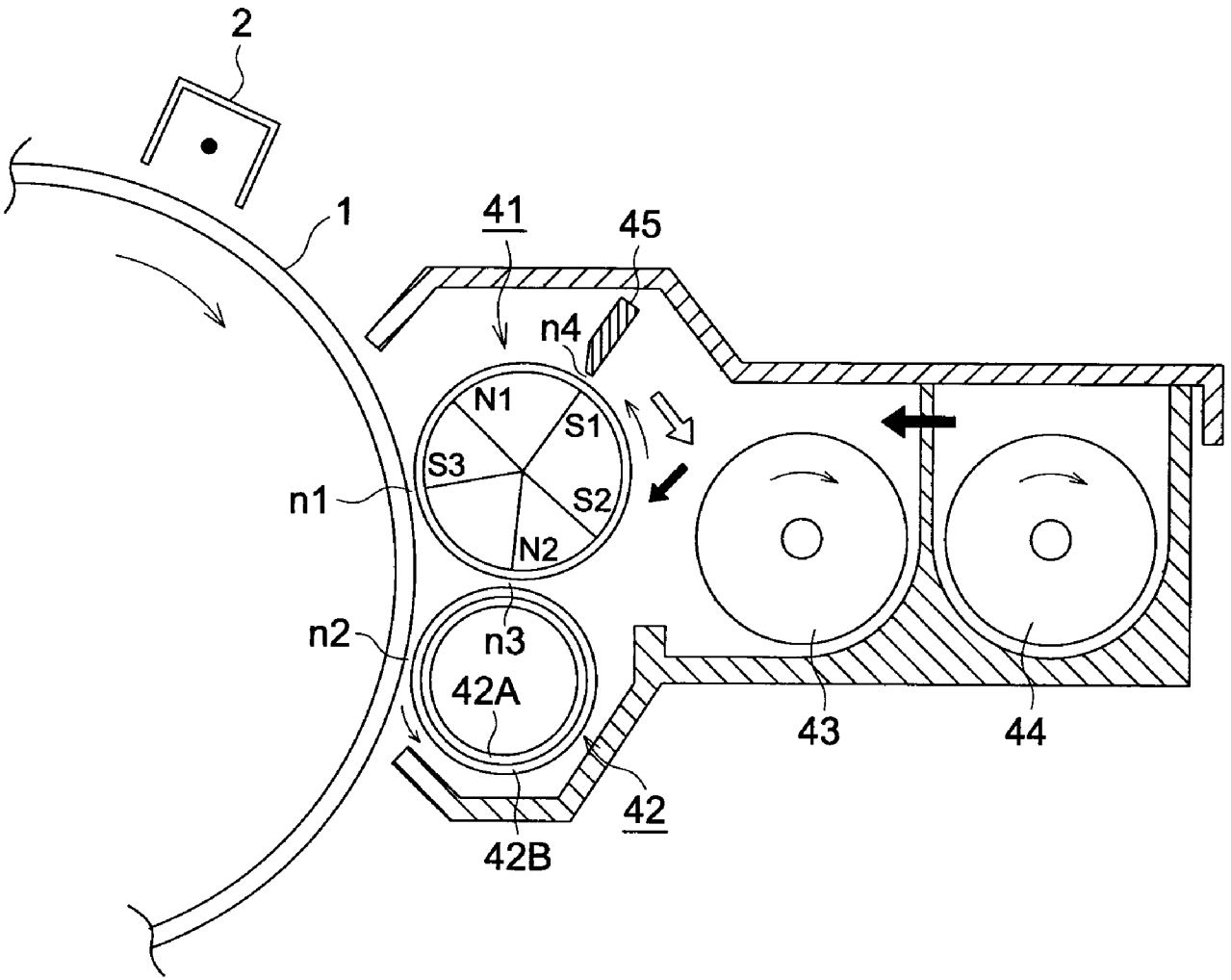
FIG. 5 is a diagram representing the periphery of a developing device 4 of Comparative Example 1.

FIG. 5 shows the developing device 4. The developing device 4 of the Comparative example 1 is structured in the same way as the developing device 4 of FIG. 4. However, the first development roller 41 rotates in the counterclockwise direction, as shown in FIG. 5. In the first development area n1, development is performed according to the with-rotation method where the photoreceptor 1 and first development roller 41 move in the same direction. The first development roller 41 rotates in the counterclockwise direction. Thus, the layer thickness regulating member 45 is located upstream of the first development roller 41.

Comparative Example 2

Figure 6:
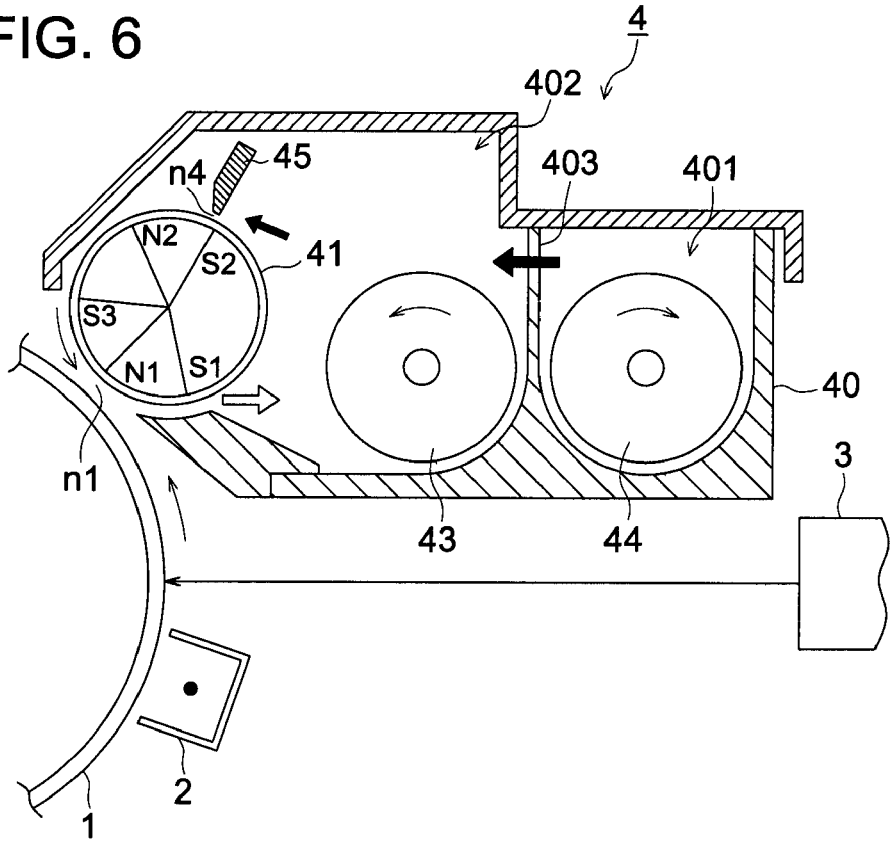
FIG. 6 is a diagram representing the periphery of a developing device 4 in Comparative Example 2.

In the Comparative example 2, tests were conducted using the developing device 4 using only the first development roller 41, and this device was not provided with a second development roller 42 carrying only the toner as a one-component developer. FIG. 6 shows the periphery of the developing device 4 in the Comparative example 2. As shown in this diagram, the first development roller 41 rotates in the counterclockwise direction. Similarly to the case of the Example, development is performed using the counter-rotation method where the photoreceptor 1 and first development roller 41 move in opposite directions in the first development area n1.

| [Common conditions] | |
|---|---|
| Average toner particle diameter: | 6.5 μm |
| Average carrier particle diameter: | 33 μm |
| Carrier magnetization: | 60 emu/g |
| Control toner density: | 7.5% by mass |

History of use of developer. The test used the developer through which 2,000 A4-sized sheets with a coverage rate of 0% were passed without stop.

TABLE 1

| | | Unit | Example | Comparative example 1 | Comparative example 2 |
|---|---|---|---|---|---|
| Potential of photoreceptor 1 | V0 (unexposed portion) | V | −650 | −750 | −650 |
| | V1 (exposed portion) | V | −80 | −50 | −80 |
| | Linear speed | mm/s | 300 | 200 | 300 |
| First development roller 41 | DC component voltage (Vdc 1) | V | −500 | −550 | −500 |
| | AC component voltage (Vac 1) | kV | 1.2 | — | 1.2 |
| | AC frequency | kHz | 7 | — | 7 |
| | Linear speed | mm/s | 540 | 650 | 540 |
| Second development roller 42 | DC component voltage (Vdc 2) | V | −200 | −250 | — |
| | AC component voltage (Vac 2) | kV | 0.8 | — | — |
| | AC frequency | kHz | 7 | — | — |
| | Linear speed | mm/s | 360 | 250 | — |
| Gap | First development area n1 | mm | 0.28 | 0.5 | 0.28 |
| | Supply position n2 | mm | 0.28 | — | — |
| | Second development area n2 | mm | 0.15 | 0 (−0.2) | — |

[Test Result]

Table 2 shows the test result and Table 3 gives the evaluation standards. As shown in Table 2, the granularity, development ghost, and gathered toner in the Example of the present invention are superior to those of the Comparative examples 1 and 2. The evaluation standards of the development ghost will be described later.

Figure 7:
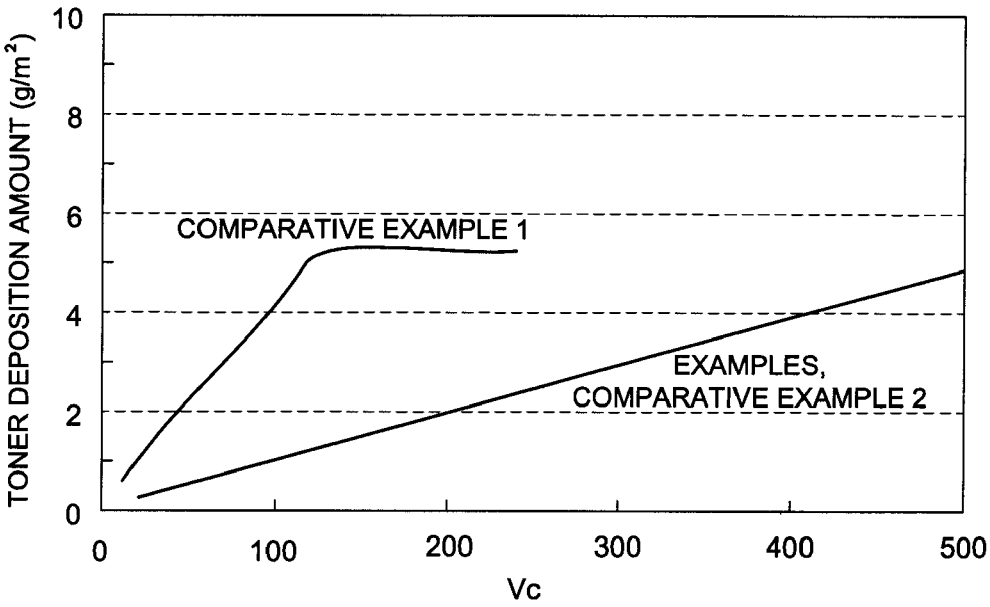
FIG. 7 is a diagram representing the relationship between contrast voltage Vc and the amount of toner transferred onto a photoreceptor 1.

FIG. 7 shows the relationship between the contrast potential Vc and the amount of toner deposition subsequent to development to the photoreceptor 1. The gradation reproducibility in the Example and Comparative example 2 is better than that of the Comparative example 1, as can be seen.

TABLE 2

| | Example | Comparative example 1 | Comparative example 2 |
|---|---|---|---|
| Granularity | A | A | B |
| Development ghost | A | B | A |
| Gathered toner | A | A | BA |

TABLE 3

| | A | B | C |
|---|---|---|---|
| Granularity | Uniform | Slightly uneven | Uneven |
| Development ghost | Density difference ≦ 0.02 | 0.03 ≦ Density difference ≦ 0.05 | 0.06 ≦ Density difference |
| Gathered toner | The density at the tail end of the patch cannot be identified to be raised. | The density at the tail end of the patch is slightly identified to be raised. | The density at the tail end of the patch is clearly identified to be raised. |

[Definition of Development Ghost]

Figure 8A:
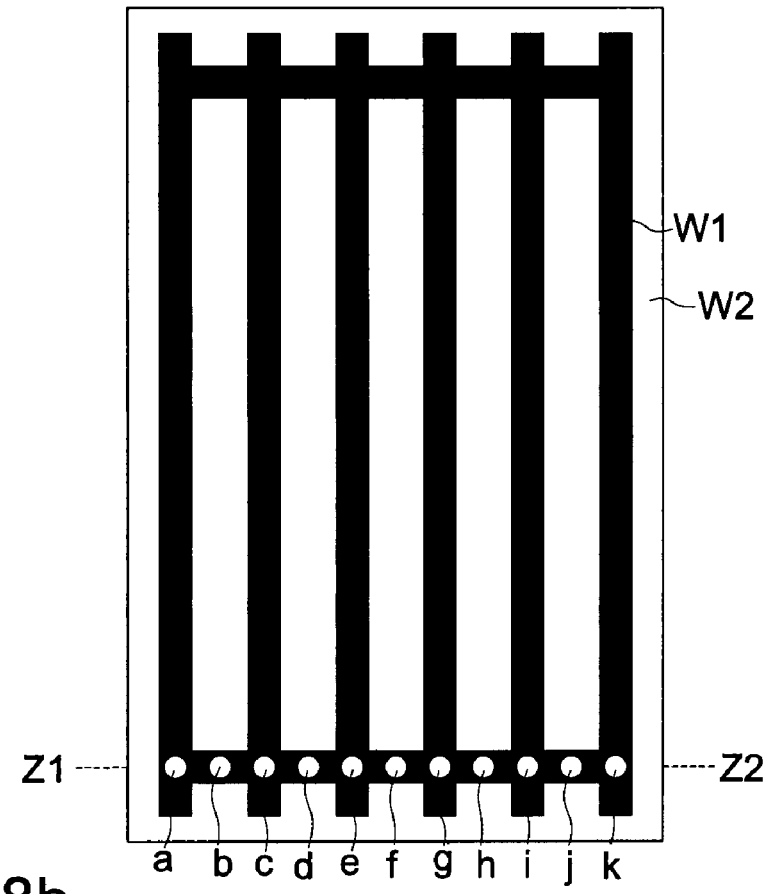
FIG. 8 is a diagram showing the development ghost.

Referring to the drawings, the development ghost of Tables 2 and 3 will be described below. FIG. 8*a* shows a development ghost evaluation pattern. The black solid portion in the diagram corresponds to the black solid portion W1 of the recording paper P. Other blank portions correspond to the white portion W2.

Using the image forming apparatus of FIG. 1 as a test machine, the aforementioned development ghost evaluation image pattern was printed out with a black developer, and the transmission density of the pattern formed on the recording paper P was measured by a transmission densitometer.

The portions a, b, c, d, e, f, g, h, i, j, and k indicate the positions for measuring the density of the black solid portion W1. For the portions b, d, f, h and j, there has been no consumption of the developer in the previous white portion W2, and a sufficient image density is obtained at the time of development process. For the portions a, c, e, g, i and k, however, much toner has been consumed on the previous black solid portion W1, and the image density is reduced at the time of the development process. Thus, the image densities of the portions a, c, e, g, i, and k are lower than those of the portions b, d, f, h and j, with the result that a density difference is produced, and the image appears less dense. Ghost is defined as an image where the density difference has occurred.

Figure 8B:
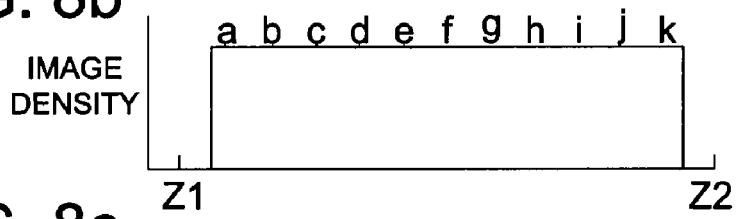

FIG. 8*b* shows the result of measuring the image density in the region Z1-Z2 perpendicular to the recording paper conveying direction, when an image of the development ghost evaluation image pattern is formed. FIG. 8*b* shows uniform image density free from a development ghost.

Figure 8C:
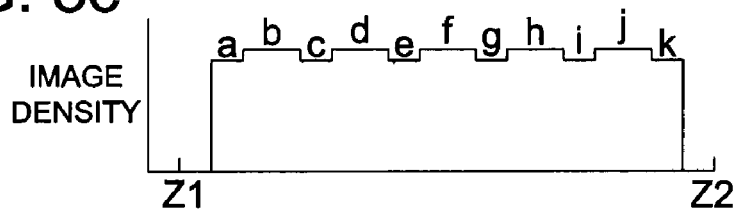

FIG. 8*c* shows a reduction in image density in the portions a, c, e, g, i, and k where a development ghost occurred.

NUMERALS

4 Developing device
40 Enclosure
41 First development roller
41A Sleeve
41B Fixed magnet
42 Second development roller
42A Sleeve
42B Coating layer
43 Supply screw
44 Agitation screw
45 Layer thickness regulating member
n1 First development area
n2 Second development area
n3 Supply position
n4 Regulation position

The invention claimed is:

1. A developing device, comprising:

a storage section for storing a two-component developer containing non-magnetic toner and magnetic carrier, wherein toner is charged to a first polarity, and carrier is charged to a second polarity that is opposite to the first polarity;

a first development roller which includes a rotating sleeve and therein a fixed magnetic pole, and is configured to carry, on a circumferential surface of the sleeve, the two-component developer stored in the storage section, and configured to develop in a first development area an electrostatic latent image formed on an image carrier, with the carried two-component developer, wherein a first development bias is applied to the first development roller;

a layer thickness regulating section for regulating at a regulation position an amount of the two-component developer carried on the circumferential surface of the sleeve; and a second development roller made of a non-magnetic material, and configured to carry on a circumferential surface thereof toner supplied from the first development roller, and to develop the electrostatic latent image on the image carrier, in a second development area which is on a downstream side from the first development area in a rotating direction of the image carrier, wherein a second development bias is applied to the second development roller, wherein the circumferential surface of the sleeve and a surface of the image carrier move in different linear directions from each other in the first development area, a supply position at which the first development roller supplies the toner to the second development roller is located on a downstream side from the regulation position and on an upstream side of the first development area in a rotating direction of the first development roller, and the first development bias and the second development bias form an electric field between the first development roller and the second development roller which attracts and transfers the non-magnetic toner from the first development roller to the second development roller while the magnetic carrier remains on the first development roller.

2. The developing device of claim 1, wherein the first polarity is negative, a polarity of the first development bias and a polarity of the second development bias are negative, and an absolute value of the first development bias is larger than an absolute value of the second development bias.

3. The developing device of claim 1, wherein the circumferential surface of the second developing roller and the surface of the image carrier move in different linear directions from each other in the second developing area.

4. The developing device of claim 1, wherein the circumferential surface of the second developing roller and the surface of the image carrier move in the same linear direction with respect to one another in the second developing area.

5. An image forming apparatus, comprising:

an image carrier;

a charging section for charging the image carrier;

an exposure section for forming an electrostatic latent image on a surface of the image carrier;

a developing device for developing the electrostatic latent image with toner to form a visible image, the developing device comprising:

a storage section for storing a two-component developer containing non-magnetic toner and magnetic carrier, wherein toner is charged to a first polarity, and carrier is charged to a second polarity that is opposite to the first polarity;

a first development roller which includes a rotating sleeve and therein a fixed magnetic pole, and is configured to carry, on a circumferential surface of the sleeve, the two-component developer stored in the storage section, and configured to develop in a first development area the electrostatic latent image on the image carrier, with the carried two-component developer, wherein a first development bias is applied to the first development roller;

a layer thickness regulating section for regulating at a regulation position an amount of the two-component developer carried on the circumferential surface of the sleeve; and a second development roller made of a non-magnetic material, and configured to carry on a circumferential surface thereof toner supplied from the first development roller, and to develop the electrostatic latent image on the image carrier, in a second development area which is on a downstream side from the first development area in a rotating direction of the image carrier, wherein a second development bias is applied to the second development roller, wherein the circumferential surface of the sleeve and a surface of the image carrier move in different linear directions from each other in the first development area, a supply position at which the first development roller supplies toner to the second development roller is located on a downstream side from the regulation position and on an upstream side of the first development area in a rotating direction of the first development roller, and the first development bias and the second development bias form an electric field between the first development roller and the second development roller which attracts and transfers the non-magnetic toner from the first development roller to the second development roller while the magnetic carrier remains on the first development roller; and a transfer section for transferring the visible image to a transfer medium.

* * * * *